US010955116B2

(12) United States Patent
Kopeckova et al.

(10) Patent No.: US 10,955,116 B2
(45) Date of Patent: Mar. 23, 2021

(54) HEAD BALANCE CONTROL SYSTEM FOR AN AUTOMATED LUMINAIRE

(71) Applicant: Robe Lighting s.r.o., Roznov pod Radhostem (CZ)

(72) Inventors: Hana Kopeckova, Bystricka (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 16/797,722

(22) Filed: Feb. 21, 2020

(65) Prior Publication Data

US 2020/0191362 A1 Jun. 18, 2020

Related U.S. Application Data

(63) Continuation of application No. 16/560,661, filed on Sep. 4, 2019.

(Continued)

(51) Int. Cl.

| | |
|---|---|
| ***F21V 14/06*** | (2006.01) |
| ***F21V 14/02*** | (2006.01) |
| ***F21V 21/15*** | (2006.01) |

(52) U.S. Cl.

CPC ..... *F21V 14/06* (2013.01); *F21V 14/02* (2013.01); *F21V 21/15* (2013.01)

(58) Field of Classification Search

CPC ..... F21V 14/06; F21V 14/02; F21V 21/15

See application file for complete search history.

(56) References Cited

U.S. PATENT DOCUMENTS

| | | | | |
|---|---|---|---|---|
| 6,736,528 | B2 | 5/2004 | Hewlett et al. | |
| 2002/0060911 | A1* | 5/2002 | Brockmann | F21V 29/74 362/321 |

(Continued)

FOREIGN PATENT DOCUMENTS

| | | | |
|---|---|---|---|
| JP | 2011-86559 | A * | 4/2011 |
| JP | 2011-86559 | A * | 4/2011 |
| WO | 2013142434 | A2 | 9/2013 |

OTHER PUBLICATIONS

Wikipedia; "Ray Transfer Matrix Analysis"; https://en.wikipedia.org/wiki/Ray_transfer_matrix_analysis; Feb. 11, 2020; 9 pages.

(Continued)

*Primary Examiner* — Rajarshi Chakraborty
*Assistant Examiner* — Nathaniel J Lee
(74) *Attorney, Agent, or Firm* — Conley Rose, P.C.; Brooks W Taylor

(57) ABSTRACT

An automated luminaire is provided that includes a luminaire head and a control system. The luminaire head includes a light engine module and a lens module. The light engine module emits a light beam and moves along an optical axis of the luminaire head. The lens module receives and projects the light beam and also moves along the optical axis of the luminaire head. The control system moves the light engine module and the lens module along the optical axis to position a center of mass of the luminaire head coincident with an axis of rotation of the luminaire head. The lens module may include a plurality of lens groups that move independently. The control system determines a desired beam angle and a desired focus and moves the light engine module and the plurality of lens groups accordingly.

10 Claims, 8 Drawing Sheets

Related U.S. Application Data

(60) Provisional application No. 62/731,552, filed on Sep. 14, 2018.

(56) References Cited

U.S. PATENT DOCUMENTS

| | | | | |
|---|---|---|---|---|
| 2014/0233244 | A1* | 8/2014 | Jurik | F21V 14/06 362/319 |
| 2016/0215961 | A1* | 7/2016 | Kjeldsen | F21V 5/007 |
| 2016/0238217 | A1* | 8/2016 | Latteo | F21V 17/02 |
| 2017/0002997 | A1* | 1/2017 | Huang | F21V 19/02 |
| 2017/0108199 | A1* | 4/2017 | Venturati | F16H 25/2015 |
| 2019/0390840 | A1 | 12/2019 | Kopeckova et al. | |

OTHER PUBLICATIONS

Wikipedia; "Center of Mass"; https://en.wikipedia.org/w/index.php?title=Center_of_mass&oldid=947367684; Mar. 25, 2020; 11 pages.
Notice of Allowance dated Nov. 6, 2019; U.S. Appl. No. 16/560,661, filed Sep. 4, 2019; 8 pages.
Office Action dated Mar. 30, 2020; U.S. Appl. No. 16/560,661, filed Sep. 4, 2019; 16 pages.
European Extended Search Report; Application No. 19196771.0; dated Dec. 16, 2019; 9 pages.
Final Office Action dated Aug. 13, 2020; U.S. Appl. No. 16/560,661, filed Sep. 4, 2019; 23 pages.
Advisory Action dated Oct. 9, 2020; U.S. Appl. No. 16/560,661, filed Sep. 4, 2019; 3 pages.

* cited by examiner

HEAD BALANCE CONTROL SYSTEM FOR AN AUTOMATED LUMINAIRE

CROSS-REFERENCE TO RELATED APPLICATIONS

This application is a continuation of U.S. patent application Ser. No. 16/560,661 filed Sep. 4, 2019 by Hana Kopeckova, et al. entitled, "Head Balance Control System for an Automated Luminaire", which claims priority to U.S. Provisional Application No. 62/731,552 filed Sep. 14, 2018 by Hana Kopeckova, et al. entitled, "Head Balance Control System for an Automated Luminaire," both of which are incorporated by reference herein as if reproduced in their entirety.

TECHNICAL FIELD OF THE DISCLOSURE

The disclosure generally relates to an automated luminaire, and more specifically to a balance system for an automated luminaire.

BACKGROUND

Luminaires with automated and remotely controllable functionality are well known in the entertainment and architectural lighting markets. Such products are commonly used in theatres, television studios, concerts, theme parks, night clubs, and other venues. A typical product will commonly provide control over the pan and tilt functions of the luminaire allowing the operator to control the direction the luminaire is pointing and thus the position of the light beam on the stage or in the studio. Typically, this position control is done via control of the luminaire's position in two orthogonal rotational axes usually referred to as pan and tilt. Many products provide control over other parameters such as the intensity, color, focus, beam size, beam shape, and beam pattern.

FIG. 1 illustrates a typical multiparameter automated luminaire system 10. These systems typically include a plurality of multiparameter automated luminaires 12 which typically each contain on-board a light source (not shown), light modulation devices, electric motors coupled to mechanical drive systems, and control electronics (not shown). In addition to being connected to mains power either directly or through a power distribution system (not shown), each automated luminaire 12 is connected in series or in parallel via data link 14 to one or more control desks 15. An operator typically controls the automated luminaire system 10 via the control desk 15.

SUMMARY

In one embodiment an automated luminaire includes a luminaire head and a control system. The luminaire head includes a light engine module and a lens module. The light engine module emits a light beam and moves along an optical axis of the luminaire head. The lens module receives and projects the light beam. The lens module also moves along the optical axis of the luminaire head. The control system moves the light engine module and the lens module along the optical axis to position a center of mass of the luminaire head coincident with an axis of rotation of the luminaire head.

In some embodiments, the lens module includes a plurality of lens groups that move independently along the optical axis and control both beam angle and focus of the projection of the modified light beam. The control system determines a desired beam angle and a desired focus of the projection of the modified light beam and moves the light engine module and the plurality of lens groups along the optical axis to produce the desired beam angle and the desired focus while maintaining the position of the center of mass of the luminaire head coincident with the axis of rotation of the luminaire head.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION

Figure 1:
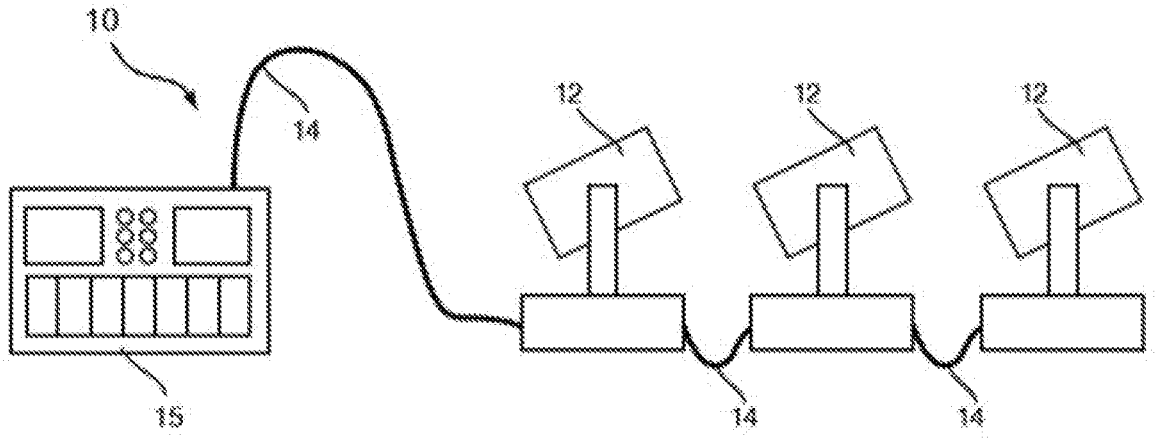
FIG 1 PRIOR ART
FIG. 1 illustrates a typical prior art automated lighting system.

Preferred embodiments are illustrated in the figures, like numerals being used to refer to like and corresponding parts of the various drawings.

An automated luminaire may include optical devices that enable the operator to control the beam angle and/or focus of the projected beam. If such control is achieved through movement of lenses or groups of lenses along an optical axis of a luminaire head of the automated luminaire, the movement of the lenses could alter the location of the center of mass of the luminaire head. Typically, the tilt axis of rotation is orthogonal to the optical axis of the luminaire head. If the lenses are large, heavy, or mounted a large distance away from the tilt axis, movement of the lenses along the optical axis could cause significant changes in the location of the center of mass relative to the tilt axis.

If the center of mass of the luminaire head is positioned too far off the tilt axis of the luminaire head, then the head can become unbalanced, creating an out of balance torque that attempts to rotate the luminaire head. A tilt positioning motor for the luminaire head might be required to oppose the out of balance torque (either actively or through a locking mechanism) in order to hold the head in a fixed tilt position. When the head is being moved to a new tilt position, the out of balance torque may produce an extra strain on the tilt motor, which may cause slow movement, juddering, or other undesirable effects. Depending upon the orientation of the luminaire head (e.g., with its center of mass coincident with the pan axis or at a distance from the pan axis), an unbalanced luminaire head may cause similar problems with the pan positioning motor and pan movement.

Disclosed herein is an automated head balance system for an automated luminaire that reduces the effect of moving lenses or groups of lenses on the location of the center of mass of the luminaire head. The automated luminaire includes a light engine module (which includes a light source module and an effects module), a lens module, and a control system. The light source module is configured to emit a light beam. The effects module is configured to controllably modify the light emitted from the light source module. The lens module is configured to controllably modify the beam angle and/or focus of the light beam emitted from the effects module.

The control system is configured to move the light engine module and the lens module along the optical axis in a coordinated manner, and to position the center of mass of the luminaire head of the automated luminaire at a location that is coincident with a tilt axis of rotation. The coordinated movement of the light engine module and the lens module may be independent of each other or the modules' movement may be mechanically coupled. The control system may be configured to calculate positions for the light engine module and the lens module so as to reduce a distance of the center of mass away from the tilt axis, and then to move the light engine module and the lens module to those calculated positions.

Figure 2:
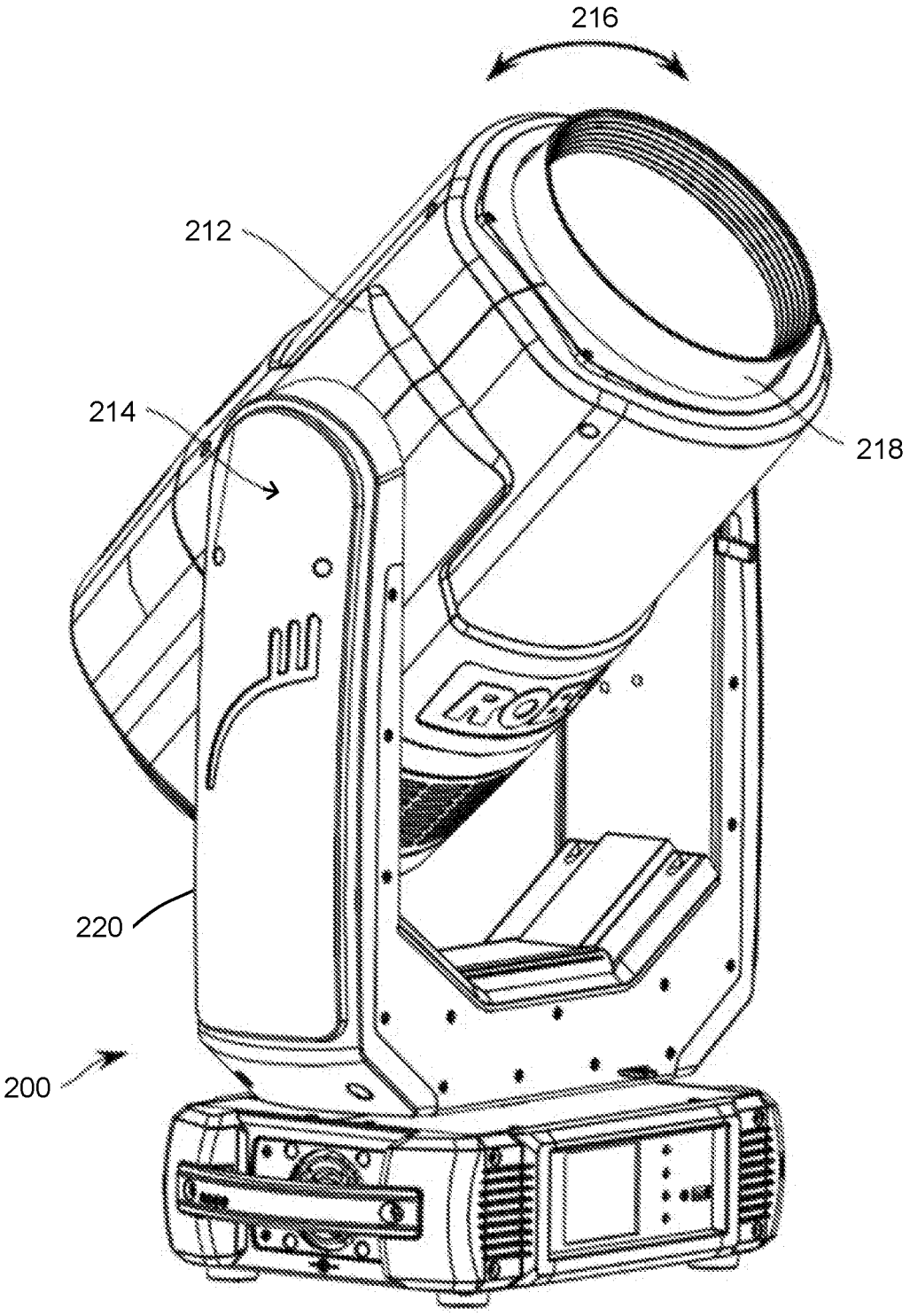
FIG. 2 illustrates an automated luminaire according to the disclosure.

FIG. 2 illustrates an automated luminaire 200 according to the disclosure. Automated luminaire 200 includes a luminaire head 212 which is configured to tilt (rotate as shown by arrow 216) around a tilt axis of rotation. The tilt axis is horizontal as shown in FIG. 2. The tilt axis is defined by pivot points 214 within an enclosing yoke 220. The automated luminaire 200 further includes a lens module with lens baffle 218.

Figure 3:
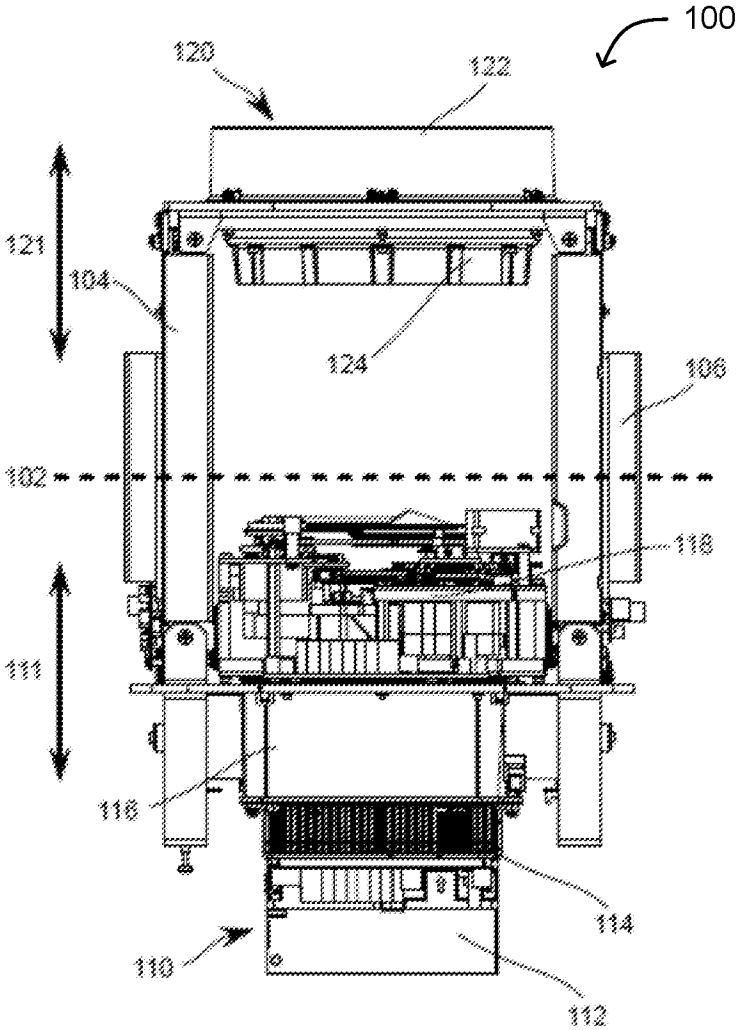
FIG. 3 shows a head balance system according to the disclosure in a first configuration.

FIG. 3 shows a head balance system 100 according to the disclosure in a first configuration. The head balance system 100 is suitable for use in the luminaire head 212 of FIG. 2. The head balance system 100 includes a light engine module 110. The light engine module 110 includes cooling fans 112, a heat sink 114, a light source module 116, and an effects module 118. The light source module 116 emits a light beam and the effects module 118 receives the emitted light beam and produces a modified light beam. In some configurations of the effects module 118, the emitted light beam is not modified and the so-called modified light beam is the same as the emitted light beam. The head balance system 100 further includes a lens module 120. The lens module 120 includes a lens system 124 and a lens baffle 122. The lens module 120 receives and projects the modified light beam. The light engine module 110 and the lens module 120 may be referred to collectively as the optical system of the luminaire head 212.

The light engine module 110 is configured to move (as shown by arrow 111) relative to a chassis 104 of the head balance system 100 along an optical axis of the luminaire head 212. The lens module 120 is also configured to move (as shown by arrow 121) relative to the chassis 104 of the head balance system 100 along the optical axis of the luminaire head 212. As described with reference to FIG. 2, the luminaire head 212 is configured to rotate around the tilt axis 102, which passes through tilt bearing support brackets 106.

The optical system (i.e., the light engine module 110 and the lens module 120) has a combined center of mass. Where the optical system outweighs other, static components (such as motors, connectors, circuitry, optical elements, etc.) of the luminaire head 212, the optical system center of mass may determine the center of mass of the luminaire head 212. However, where the combined weight of one or more such other components of the luminaire head 212 is nearer in weight to the weight of the optical system, the center of mass of the luminaire head 212 may be offset from the optical system center of mass by the weights and positions of the other components and a calculation of the center of mass of the luminaire head 212 is based on a weight and position of the light engine module 110, a weight and position of the lens module 120, and weight(s) and static position(s) of the other components of the luminaire head 212.

It is desirable that a location of the center of mass of the luminaire head 212 be kept coincident with the tilt axis 102, in order to minimize out of balance torque. FIG. 3 shows the light engine module 110 in its rearmost position and lens module 120 in its forward-most position. With the modules in these positions the optical system center of mass is located coincident with the tilt axis 102. For the purpose of this disclosure, the location of the center of mass is considered coincident with the tilt axis 102 when the center of mass is no farther from the tilt axis 102 than 10% of a length of the luminaire head 212 along its optical axis. Also, for the purpose of simplicity in this disclosure, the optical system center of mass will be treated as determinative of the center of mass of the luminaire head 212.

Figure 4:
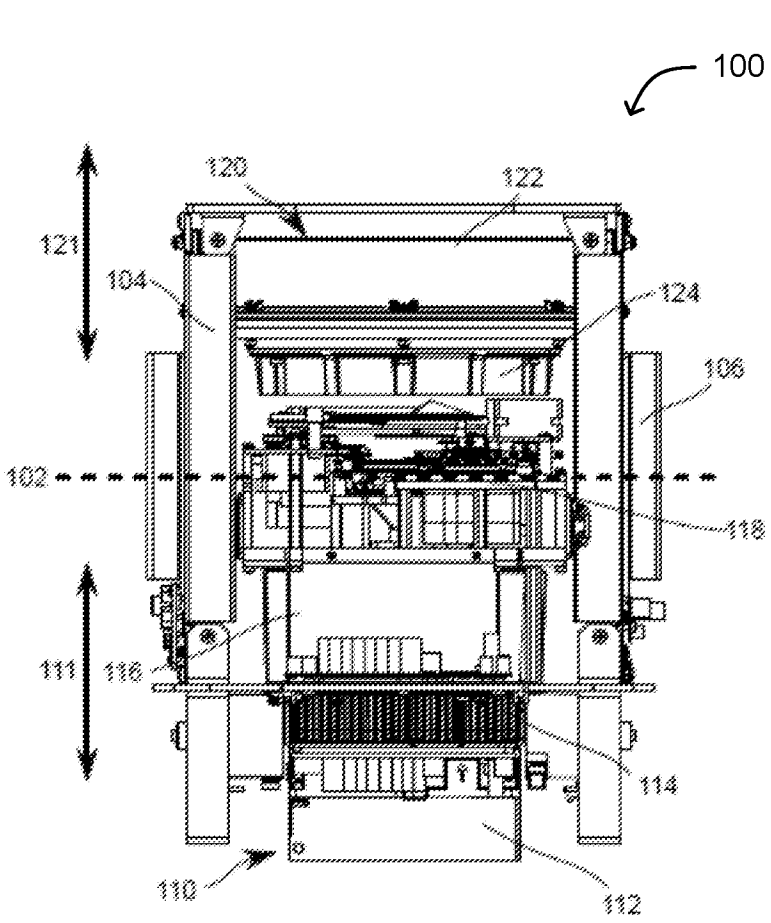
FIG. 4 shows the head balance system of FIG. 3 in a second configuration.

FIG. 4 shows the head balance system 100 of FIG. 3 in a second configuration. In this configuration, the light engine module 110 is in its forward-most position and the lens module 120 is in its rearmost position. With the modules in these positions, the optical system center of mass remains coincident with the tilt axis 102.

The separation of the light engine module 110 and the lens module 120 controls a beam angle of a light beam emitted by the luminaire head 212. In the configuration shown in FIG. 3, the light beam has a minimum beam angle, while in the configuration shown in FIG. 4, the light beam has a maximum beam angle.

In the embodiment shown in FIGS. 3 and 4, the lens module 120 comprises a single lens. However, in other embodiments the lens module 120 comprises a unitary lens group that maintains a constant spacing between the lenses of the group as the lens module 120 moves relative to the light engine module 110. The lens modules 120 of such embodiments may project a light beam received from the light engine module 110 with a fixed focus at infinity (or other large distance from the lens module 120). Thus, movement of the lens module 120 may be controlled with a single control channel and movement of the lens module 120 controls only the beam angle of a projected beam, but not a focus of the projected beam.

In still other embodiments, the lens module 120 comprises a lens group in which spacing between subgroups of lenses of the lens module 120 may be varied, allowing both the focus and the beam angle of the projected beam to be controlled. For purposes of this disclosure, a subgroup of lenses may include only a single lens. Typically, such lens modules will be controlled with two control channels: one to position a first subgroup of lenses to control focus and the other to position a second subgroup of lenses to control beam angle. Other such lens modules may include three or more subgroups of lenses.

In lens module embodiments that provide for varying the spacing between subgroups of lenses, all the subgroups of lenses may be mounted on a single sub-chassis, with the subgroups of lenses configured for controlled motion relative to the sub-chassis. In such embodiments, the sub-chassis may be configured for controlled motion relative to the chassis 104 of the head balance system 100. In other such lens module embodiments, however, one or more subgroups of lenses may be mounted on a first sub-chassis and one or more other subgroups of lenses mounted on a second sub-chassis, where each of the first and second sub-chassis is configured for individual, independent controlled motion relative to the chassis 104.

Figure 5:
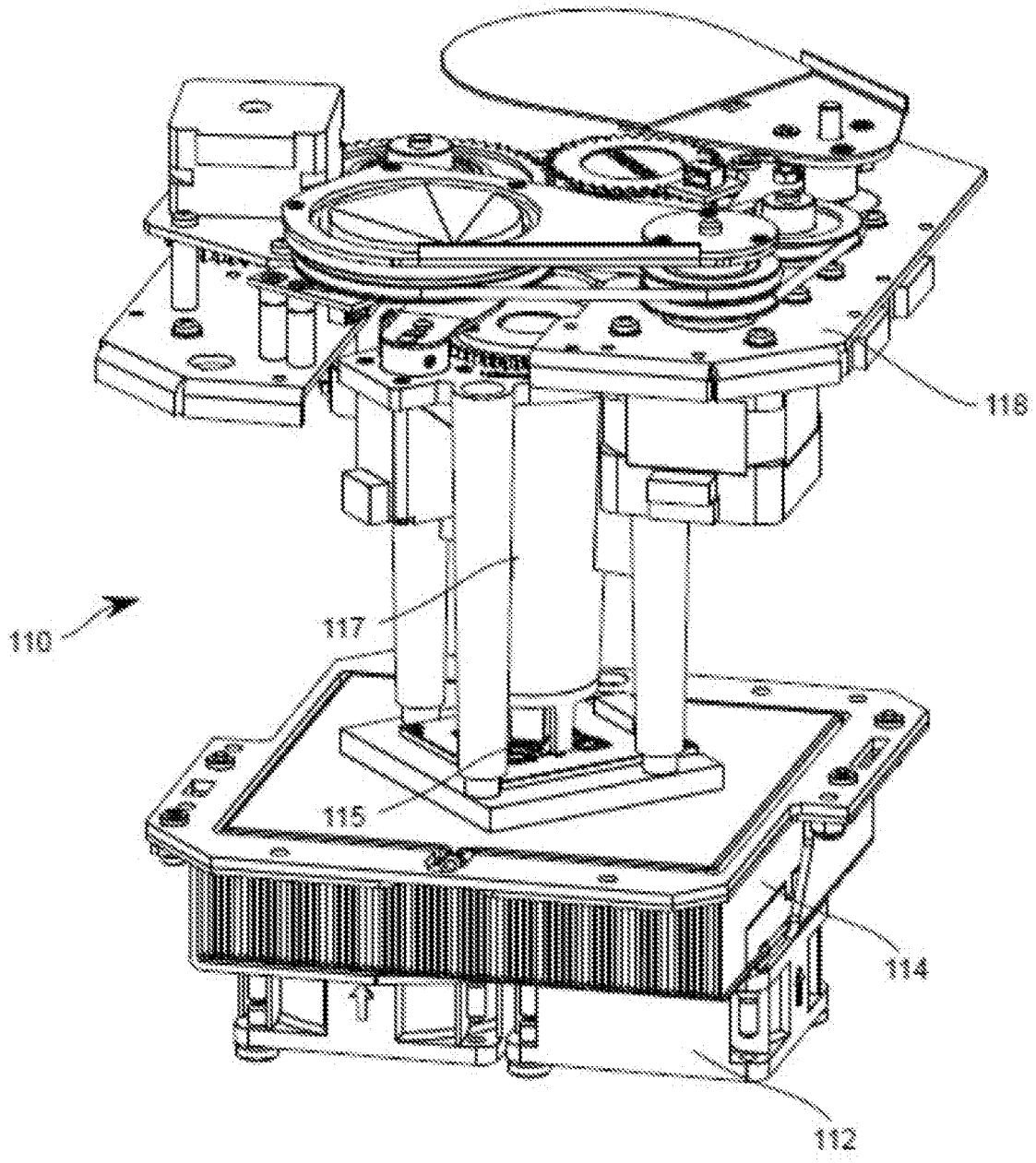
FIG. 5 presents the light engine module of FIG. 3.

FIG. 5 presents the light engine module 110 of FIG. 3. As partially described with reference to FIG. 3, the light engine module 110 includes the cooling fans 112, the heat sink 114, a light source 115, a light collimation and homogenizing system 117, and the effects module 118. Collectively, the light source 115 and the light collimation and homogenizing system 117 comprise the light source module 116. The light source 115 is a light emitting diode (LED). In other embodiments, other light sources, including incandescent, organic LED (OLED), or high-intensity discharge (HID) lamp. In some such embodiments, the light collimation and homogenizing system 117 may be omitted. In some embodiments, the effects module 118 includes light modulation devices such as, but not limited to, a gobo wheel, a color wheel, a rotating gobo, a prism, a rotating prism, a diffusion filter, a shutter, an iris, or other optical devices. The effects module 118 may further include motors, solenoids, or other actuators to control the effects. Such actuators may be controlled using electronics, which may be coupled to sensors in the effects module 118.

Figure 6:
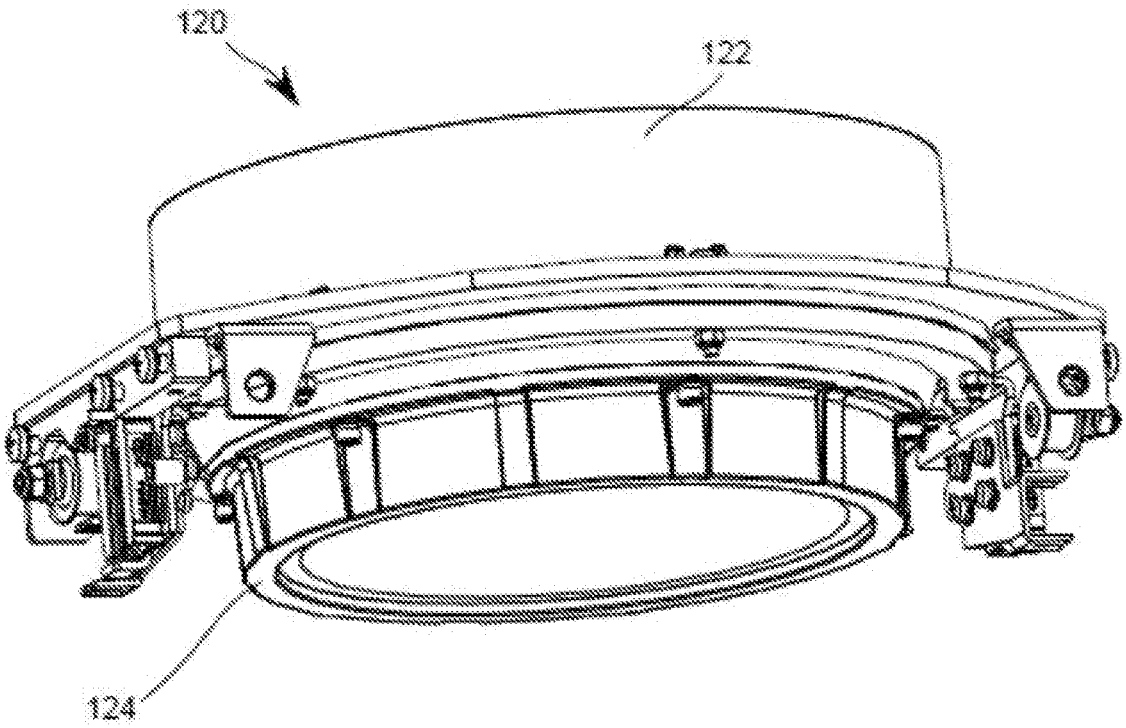
FIG. 6 presents the lens module of FIG. 3.

FIG. 6 presents the lens module 120 of FIG. 3. As described with reference to FIG. 3, the lens module 120 includes the lens system 124 and the lens baffle 122. In some embodiments, the lens system 124 includes a plurality of individual lens elements.

Figures 7A, 7B, 7C:
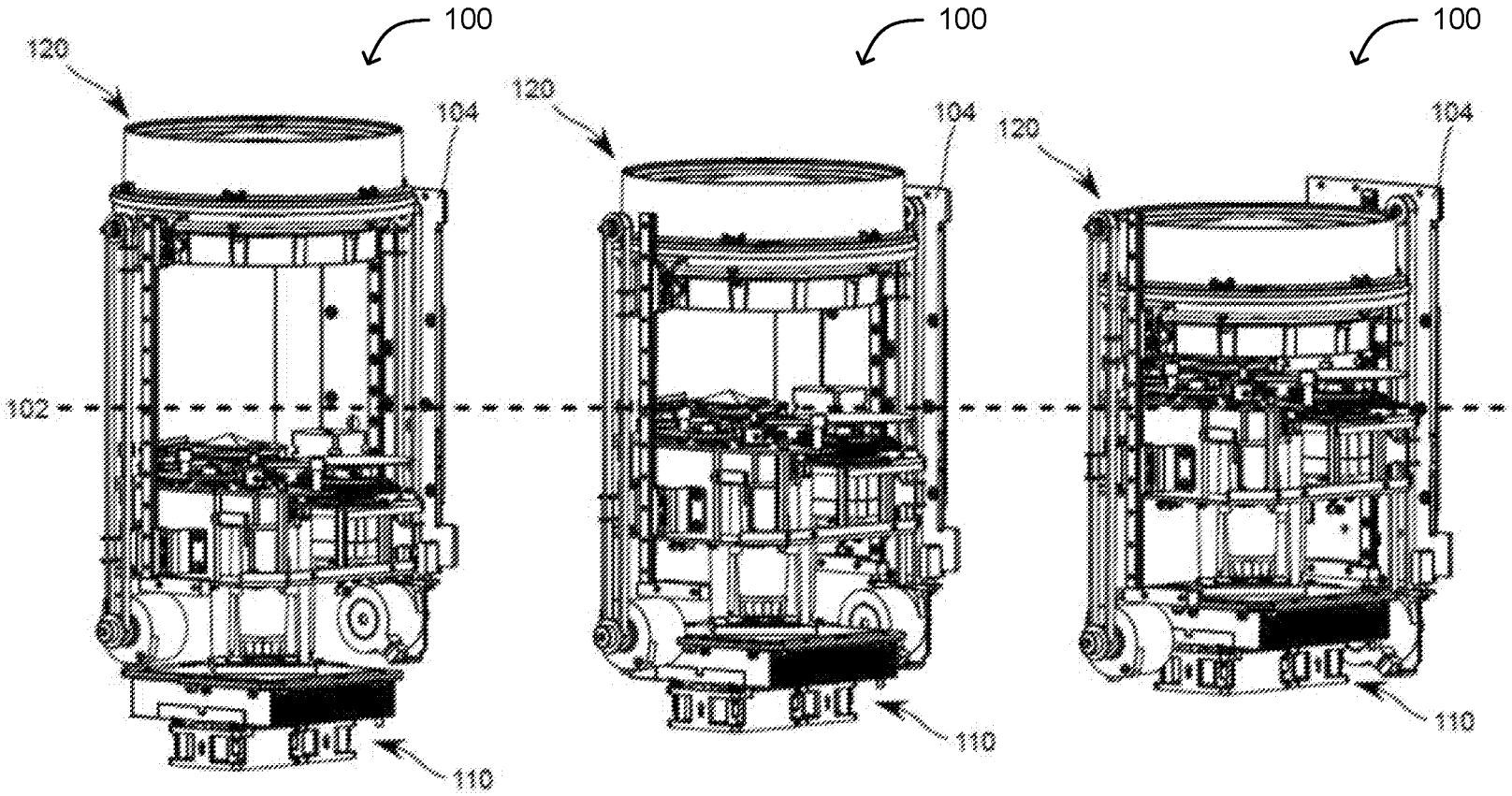
FIGS. 7A-C show the head balance system of FIG. 3 in three configurations.

FIGS. 7A-C show the head balance system 100 of FIG. 3 in three configurations. In each of the three configurations, the separation between the light engine module 110 and the lens module 120 is different; however, in each of the three configurations the location of the optical system center of mass is positioned coincident with the tilt axis 102.

Figure 8:
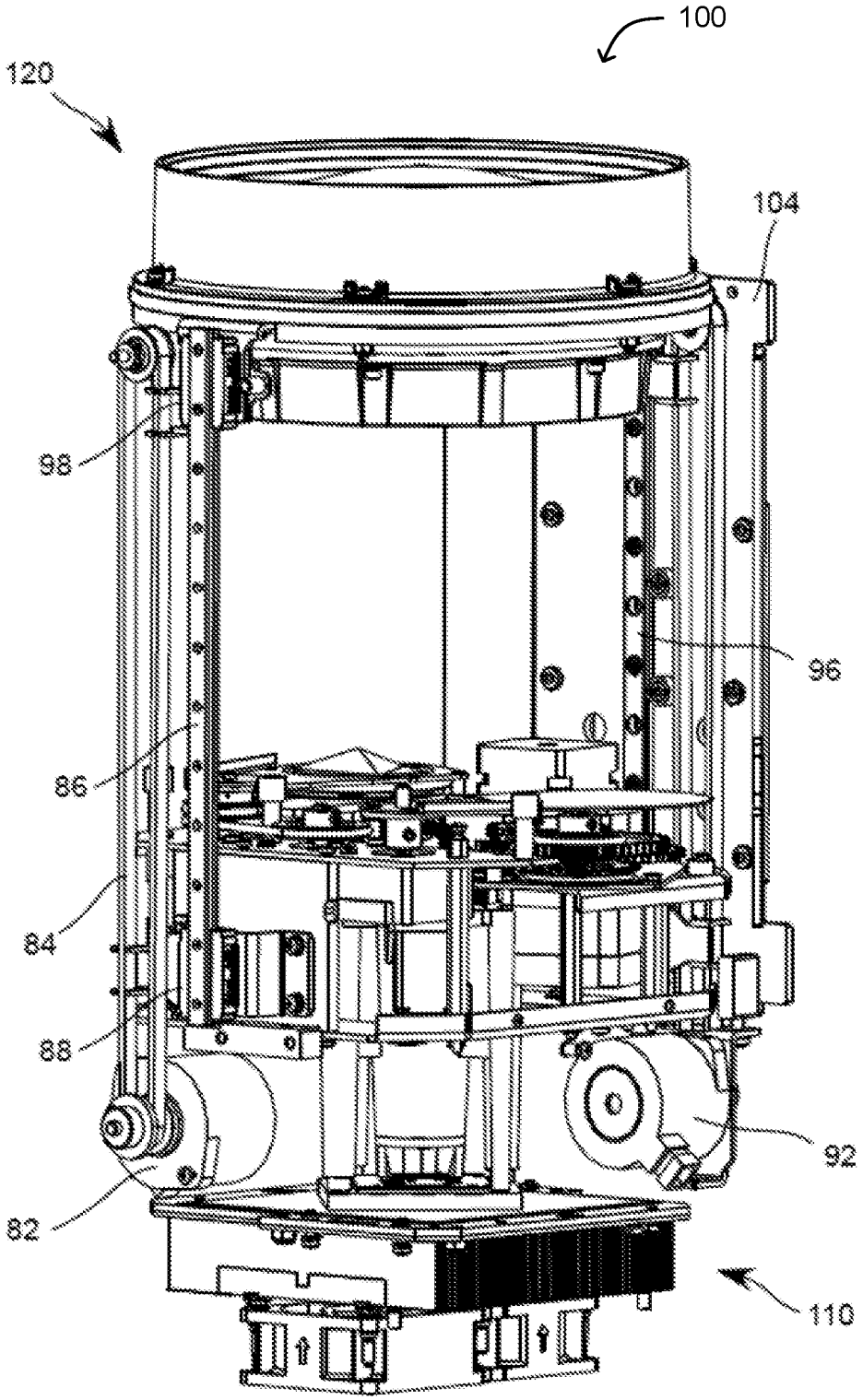
FIG. 8 illustrates the head balance system of FIG. 3 in the first configuration of FIG. 3.

FIG. 8 illustrates the head balance system 100 of FIG. 3 in the first configuration of FIG. 3. The light engine module 110 and the lens module 120 are supported by carriers 88 and 98, respectively, on slider rail 86. The light engine module 110 and the lens module 120 are also supported by carriers (not visible in FIG. 8) on slider rail 96. The carriers 88 and 98 provide a bearing surface constraining their movement, as well as the movement of the light engine module 110 and the lens module 120, along the optical axis of the luminaire head 212. Motors 82 and 92 move the light engine module 110 and the lens module 120 via a first drive belt system 84 alongside slider rail 86 and a second drive belt system alongside slider rail 96. The second drive belt system is not visible in FIG. 8. The motors 82 and 92 may be stepper motors, servo motors, linear actuators, or other suitable actuators.

The head balance system 100 illustrated in FIG. 8 comprises a drive mechanism for the light engine module 110 and the lens module 120 that include drive belt systems. Other embodiments may include other drive mechanisms for the light engine module 110 and the lens module 120, such as a lead screw or a linear actuator, or other suitable drive mechanism.

In some embodiments, only the light engine module 110 and the lens module 120 are supported by the slider rails 86 and 96. In other embodiments, other optical devices are also mounted to the slider rails 86 and/or 96. Such optical devices may be moveably or statically mounted to the slider rails 86 and 96. In still other embodiments, a housing of the luminaire head 212 or other external component of the luminaire head 212 is mounted to the slider rails 86 and 96.

In some embodiments, the head balance system 100 includes sensors, and a control system of the automated luminaire is configured to use such sensors to determine a current position of one or both of the light engine module 110 and the lens module 120 and to control the positions of the light engine module 110 and the lens module 120 along the slider rails 86 and 96. Such sensor systems may be Hall effect sensors, but the disclosure is not so limited, and any sensing system may be utilized, including, but not restricted to, magnetic sensors, optical sensors, and switch sensors.

In some embodiments, the light engine module 110 and the lens module 120 are mechanically interlinked and collectively controlled by motors 82 and 92, the first belt system 84, and the second belt system, such that the motion of motors 82 and 92 simultaneously moves the light engine module 110 in one direction and the lens module 120 in the opposite direction, thus moving the two modules towards or away from each other. One such embodiment is shown in FIG. 8. In such embodiments a single control output from the control system may be used to control both motors, as they both move together in synchronism.

In other embodiments, movement of the light engine module 110 is controlled by a first motor and belt system, while movement of the lens module 120 is independently controlled by a second motor and belt system. In such embodiments, each motor independently controls movement (and thereby position) of just one of the two modules. The control system in such embodiments may use two control outputs, one for each motor, to independently control the movement of the light engine module 110 and the lens module 120 towards or away from each other. Such embodiments may provide a greater accuracy of control of the location of the optical system center of mass than embodiments where movement of the two modules is mechanically interlinked.

Figure 9:
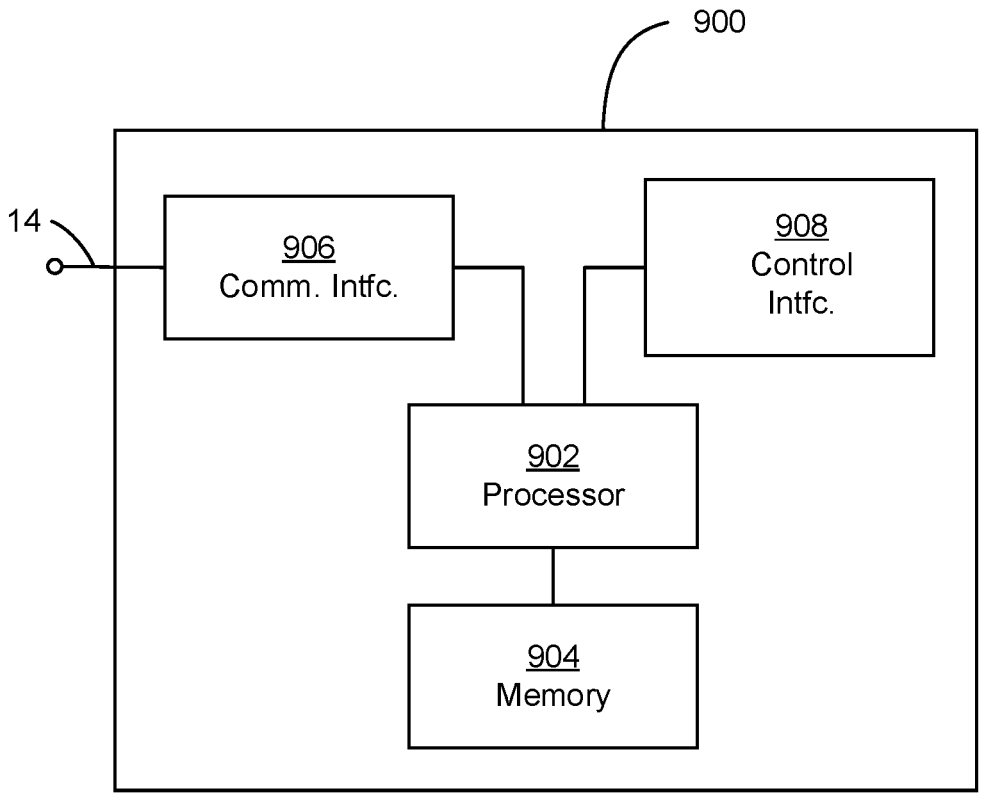
FIG. 9 presents a block diagram of a control system for an automated luminaire according to the disclosure.

FIG. 9 presents a block diagram of a control system (or controller) 900 for an automated luminaire 200 according to the disclosure. The control system 900 is suitable for controlling the head balance system 100 of FIG. 3 or other head balance systems according to the disclosure. The control system 900 is also suitable for controlling other control functions of the automated luminaire system 10. The control system 900 includes a processor 902 electrically coupled to a memory 904. The processor 902 is implemented by hardware and software. The processor 902 may be implemented as one or more Central Processing Unit (CPU) chips, cores (e.g., as a multi-core processor), field-programmable gate arrays (FPGAs), application specific integrated circuits (ASICs), and digital signal processors (DSPs).

The processor 902 is further electrically coupled to and in communication with a communication interface 906. The communication interface 906 is coupled to, and configured to communicate via, the data link 14. The processor 902 is also coupled via a control interface 908 to one or more sensors, motors, actuators, controls and/or other devices. The processor 902 is configured to receive control signals via the communication interface 906 and to control the head balance system 100 and other mechanisms of the automated luminaire system 10 via the control interface 908.

The control system 900 is suitable for implementing processes, motion control, control of the location of the optical system center of mass, and other functionality as disclosed herein. Such control may be implemented as instructions stored in the memory 904 and executed by the processor 902. The memory 904 may be volatile and/or non-volatile and may be read-only memory (ROM), random access memory (RAM), ternary content-addressable memory (TCAM), and/or static random-access memory (SRAM). The memory 904 may comprise one or more disks, tape drives, and/or solid-state drives and may use such disks and drives as overflow data storage devices, to store programs when such programs are selected for execution, and to store instructions and data that are read during program execution.

The light engine module 110 and the lens module 120 of the head balance system 100 are moved along the slider rails 86 and 96 by the motors 82 and 92 under the control of the control system 900. As described with reference to FIG. 4, the separation of the light engine module 110 and the lens module 120 controls a beam angle of a light beam emitted by the luminaire head 212. The control system 900 may determine a desired beam angle for the projected light beam from a stored value of beam angle. The control system 900 may additionally or alternatively determine a desired beam angle based on a signal from a control desk 15 or other external source received via the data link 14.

In embodiments of the lens module 120 that include a plurality of independently controlled subgroups of lenses, the control system 900 may additionally or alternatively determine a desired focus of the projected light beam from either a stored value of focus or from a second signal received from an external source received via the data link 14.

Once the control system 900 determines the desired beam angle and/or focus of the projected light beam, it calculates a separation between the light engine module 110 and the lens module 120 that produces the desired beam angle. In embodiments of the lens module 120 that include a plurality of subgroups of lenses, the control system 900 also calculates separation(s) between the subgroups of lenses. The control system 900 further calculates positions of the light engine module 110 and the lens module 120 (or the subgroups of lenses of the lens module 120) such that the calculated separations are achieved and the center of mass of the luminaire head 212 is positioned coincident with the tilt axis 102. As described with reference to FIG. 3, in some embodiments this calculation of the center of mass of the luminaire head 212 relies solely on the optical system center of mass. In other embodiments, this calculation includes the effect of other components of the luminaire head 212 on its center of mass.

The light engine module 110 and lens module 120 may have different masses, in addition to ranges of motion that are at different distances from the tilt axis 102. Furthermore, as described with reference to FIGS. 3 and 4, in embodiments where the lens module 120 includes a single sub-chassis with lenses of the lens module 120 configured for controlled motion relative to the sub-chassis, the center of mass of the lens module 120 may change location relative to the sub-chassis as the lenses move. Similarly, as described with reference to FIGS. 3 and 4, in embodiments where the lens module 120 comprises a plurality of independently positioned sub-chassis with associated lenses, each sub-chassis will contribute differently to the optical system center of mass. The control system may take these differences into account when calculating positions of the two (or more) modules to maintain the location of the center of mass of the optical system coincident with the tilt axis 102.

In embodiments where movement of the light engine module 110 is controlled independently from movement of the lens module 120, the control system 900 may move both modules simultaneously from their current positions to new positions that produce the desired beam angle. The control system 900 may perform these movements in a way that maintains the position of the center of mass of the luminaire head 212 coincident with the tilt axis 102 while the two modules are moving, maintaining the location of the center of mass of the luminaire head 212 coincident with the tilt axis 102.

While the disclosure has been described with respect to a limited number of embodiments, those skilled in the art, having benefit of this disclosure, will appreciate that other embodiments may be devised which do not depart from the scope of the disclosure herein. While the disclosure has been described in detail, it should be understood that various changes, substitutions and alterations can be made hereto without departing from the spirit and scope of the disclosure.

What is claimed is:

1. An automated luminaire comprising:

a luminaire head comprising:

a light engine module configured to emit a light beam, the light engine module configured to move along an optical axis of the luminaire head; and a lens module optically coupled to the light engine module and configured to receive the light beam and to project the light beam, the lens module configured to move along the optical axis; and a control system comprising a processor and memory, the processor configured to execute instructions stored in memory to:

determine by the processor a desired beam angle for the projected light beam from one of a value stored in memory and a signal received via a data link from an external source;

calculate by the processor a separation between the light engine module and the lens module that produces the desired beam angle;

calculate by the processor a light engine module position and a lens module position within the luminaire head that (i) provides the calculated separation and (ii) positions the center of mass of the luminaire head coincident with an axis of rotation of the luminaire head; and move the light engine module and the lens module independently along the optical axis within the luminaire head to the light engine module position and the lens module position, respectively.

2. The automated luminaire of claim 1, wherein the control system is configured to maintain the location of the center of mass of the luminaire head coincident with the axis of rotation of the luminaire head while moving the light engine module and the lens module from current respective positions to the light engine module position and the lens module position.

3. The automated luminaire of claim 1, further comprising: a light engine stepper motor configured to move the light engine module along the optical axis; and a lens engine stepper motor configured to move the lens module along the optical axis, the light engine stepper motor and the lens engine stepper motor being electrically coupled to the control system, the control system configured to move the light engine module and the lens module along the optical axis within the luminaire head by controlling the light engine stepper motor and the lens engine stepper motor.

4. The automated luminaire of claim 1, wherein the luminaire head comprises one or more other components and the control system is configured to calculate the center of mass of the luminaire head based on a weight and position of the light engine module, a weight and position of the lens module, and weight(s) and position(s) of the one or more other components.

5. The automated luminaire of claim 1, wherein the lens module comprises a plurality of lens groups configured to move independently along the optical axis and to control both beam angle and focus of the projection of the modified light beam.

6. The automated luminaire of claim 5, wherein the control system is configured to maintain the location of the center of mass of the luminaire head coincident with the axis of rotation of the luminaire head while moving the light engine module and the plurality of lens groups from current respective positions to the light engine module position and the lens module position.

7. The automated luminaire of claim 5, wherein the control system is configured to:

determine by the processor a desired focus of the projection of the modified light beam from one of a value stored in memory and a signal received via a data link from an external source; and move at least one lens group of the plurality of lens groups along the optical axis to produce the desired focus.

8. The automated luminaire of claim 7, wherein the control system is configured to:

determine by the processor the desired beam angle based on a first signal received by the control system from an external source; and determine by the processor the desired focus based on a second signal received by the control system from an external source.

9. The automated luminaire of claim 7, wherein the control system is configured to calculate by the processor separations between the lens groups of the plurality of lens groups and a separation between the light engine module and the plurality of lens groups that produces the desired beam angle and focus.

10. The automated luminaire of claim 1, wherein the light engine module comprises an effects module configured to receive a first light beam from a light source and to produce a modified light beam, and the lens module is configured to receive the modified light beam and to project the modified light beam.

* * * * *